US011801973B2

(12) United States Patent
Stacy

(10) Patent No.: US 11,801,973 B2
(45) Date of Patent: Oct. 31, 2023

(54) FORKLIFTABLE STEEL DRUM

(71) Applicant: William Stacy, Houston, TX (US)

(72) Inventor: William Stacy, Houston, TX (US)

( * ) Notice: Subject to any disclaimer, the term of this patent is extended or adjusted under 35 U.S.C. 154(b) by 0 days.

(21) Appl. No.: 17/365,413

(22) Filed: Jul. 1, 2021

(65) Prior Publication Data

US 2023/0002116 A1 Jan. 5, 2023

(51) Int. Cl.
*B65D 25/22* (2006.01)
*B65D 1/16* (2006.01)

(52) U.S. Cl.
CPC ..... *B65D 25/22* (2013.01); *B65D 1/16* (2013.01)

(58) Field of Classification Search
CPC ..... B65D 15/02; B65D 11/06; B65D 7/42; B65D 7/045; B65D 1/12; B65D 25/22; B65D 1/16; B65D 2251/1058; B65D 81/3802; B65D 39/0088; B65D 39/0041; B65D 19/00–44; B65D 2588/12; B65D 2571/00006; B65D 2519/00796; B65D 88/1687; B65D 77/245; B65D 71/0088
See application file for complete search history.

(56) References Cited

U.S. PATENT DOCUMENTS 3,244,312 A * 4/1966 Lawson ..... B65D 45/20 D9/426
3,443,735 A * 5/1969 Meijers ..... B65D 15/02 229/117.27
3,940,011 A 2/1976 Dubois
4,116,374 A * 9/1978 Garello ..... F17C 13/084 215/396
4,203,526 A * 5/1980 Stoll, III ..... B65D 7/045 D34/39
4,385,709 A * 5/1983 Ames ..... B65D 1/46 220/759
4,489,847 A * 12/1984 Ames ..... B65D 1/46 220/759
4,500,007 A * 2/1985 Stoll, III ..... B65D 7/045 220/4.05
4,605,126 A * 8/1986 Goedken ..... B65D 19/00 220/724
4,690,299 A * 9/1987 Cannon ..... B65D 7/045 D34/39
4,768,673 A * 9/1988 Przytulla ..... B65D 25/22 220/649
5,014,873 A * 5/1991 Clemens ..... B65D 1/20 D34/39

(Continued)

FOREIGN PATENT DOCUMENTS

| | | |
|---|---|---|
| DE | 2503682 | 1/1975 |
| EP | 0847929 | 4/1997 |
| GB | 2446392 | 8/2008 |

*Primary Examiner* — Kareen K Thomas
(74) *Attorney, Agent, or Firm* — Fraley Patent Law

(57) ABSTRACT

A forkliftable drum for the transportation and storage of materials is disclosed herein. The drum is comprised of a top ring having a series of forklift pockets arranged around the circumference to allow lifting and transporting of the drum by a forklift. Two or more drums may be connected by means of straps or threaded fasteners to create a bundle which can be transported without pallets. Drums of varying capacities may be provided which have the same diameter, allowing different capacity drums to be integrated into a single bundle.

18 Claims, 7 Drawing Sheets

(56) References Cited

U.S. PATENT DOCUMENTS

| | | | | | |
|---|---|---|---|---|---|
| 5,071,028 | A * | 12/1991 | Murphy | B65D 7/42 | 220/601 |
| 5,199,570 | A | 4/1993 | McKeazle | | |
| 5,628,342 | A * | 5/1997 | McNealy | F17C 1/00 | 137/590 |
| 6,047,846 | A * | 4/2000 | Watson | B65D 1/16 | 220/601 |
| 6,325,212 | B2 | 5/2001 | Przytulla | | |
| 2005/0205453 | A1 | 9/2005 | Gindi | | |
| 2008/0011638 | A1 | 1/2008 | Anderson | | |
| 2015/0144644 | A1* | 5/2015 | Craig | B29C 69/00 | 156/154 |
| 2018/0222657 | A1 | 8/2018 | Rundin | | |
| 2019/0144165 | A1 | 5/2019 | Oltman | | |
| 2020/0231330 | A1 | 7/2020 | Falvey | | |
| 2020/0231336 | A1 | 7/2020 | Falvey | | |

* cited by examiner

FORKLIFTABLE STEEL DRUM

FIELD OF THE INVENTION

This invention relates to containers for transporting materials. More specifically, this invention is related to a shipping drum. Even more specifically, the invention is related to a forkliftable drum that can be manipulated alone or in bundles by a forklift without the use of pallets.

BACKGROUND

Containers have been used since antiquity to transport oil, chemicals, and food. One of the most common containers is the steel drum. Steel drums come in a variety of sizes, such as the ubiquitous 55 gallon, and are inexpensive, durable, and reusable. Steel drums have a number of disadvantages, however.

Transporting conventional drums can be cumbersome and even dangerous to people. Drums are often placed on a pallet which can be moved using a forklift or pallet jack. The drums are then held onto the pallet with straps or plastic wrap. Because the pallet is underneath the containers, if the straps or plastic wrap fail to hold the drum, the drum can tip over and cause injury or break, spilling the contents.

Even if only one drum is transported, an entire pallet must be used, which takes up space in trucks and shipping containers, reducing shipping efficiency. Pallets are not only cumbersome to deal with once the drums are removed from the pallets, but the pallets themselves create waste.

Existing drums of varying capacities have different heights and diameters, making stacking and bundling different sized drums difficult.

Handling of drums is also a significant source of injury in the workplace. The drums may tip over or fall off a pallet during transport, potentially injuring nearby workers. Drums are often manually transported without pallets by tipping them slightly and rolling them along the ground. Strains and hernias can result from handling such heavy drums. The heavy drums may crush a handler's foot or smash a limb against a wall.

It would therefore be advantageous to have a container which avoids these and other drawbacks of existing containers.

SUMMARY OF THE INVENTION

A forkliftable drum is provided that is designed to be lifted directly by a forklift, eliminating the need for palleting drums. Forkliftable drums disclosed herein may be stacked and nested on top of each other and strapped or otherwise secured together to create a bundle. Several different capacities of drums may be provided which all have the same diameter, allowing different capacity drums to be stacked on each other.

A forkliftable drum according to one embodiment comprises a cylindrical body having a bottom and a top which define an interior volume therein for holding material within the drum. A top ring is attached to the upper edge of the cylindrical body and extends over the top of the body. The top ring has at least two forklift pockets which are configured to accept a fork of a forklift.

The top ring according to one embodiment may have an upper and lower flange formed by bending a portion of the top ring to create the forklift pockets. Holes may pass through the upper and lower flanges and the top ring to allow a fastener to be inserted through two adjacent drums to attach the drums together to form a bundle.

The top ring according to another embodiment may comprise a rectangular tube which passes through the top ring to create the forklift pockets. The rectangular tube may extend beyond an outer circumference of the top ring and may sit against the tube of an adjacent drum in a bundle to help stabilize the bundle.

The forkliftable drum may comprise a bottom ring attached to a lower end of the cylindrical body. The bottom ring may comprise a plurality of flats which are vertically aligned with the forklift pockets. Strapping material may be used to secure two or more drums when bundled. An upper strapping hole in the top ring, a lower strapping hole in the flat of the bottom ring, and strapping holders attached to the body of the drum are designed to accept strapping used to bundle two or more drums together.

A forkliftable drum may also be formed using a removable top ring which locks onto existing drums. A locking section of the removable top ring is designed to surround a portion of the drum. The top ring may have a nut and bolt clamp or a locking lever for securing and releasing the top ring to the drum. Such a removable top ring may be used to retrofit an existing drum to create a forkliftable drum. A removable top ring may also be used on open top drums in place of a traditional locking ring.

DETAILED DESCRIPTION

Existing shipping drums are cumbersome to transport and are prone to causing injury as well as waste. To this end a forkliftable drum is provided herein.

Figure 1A:
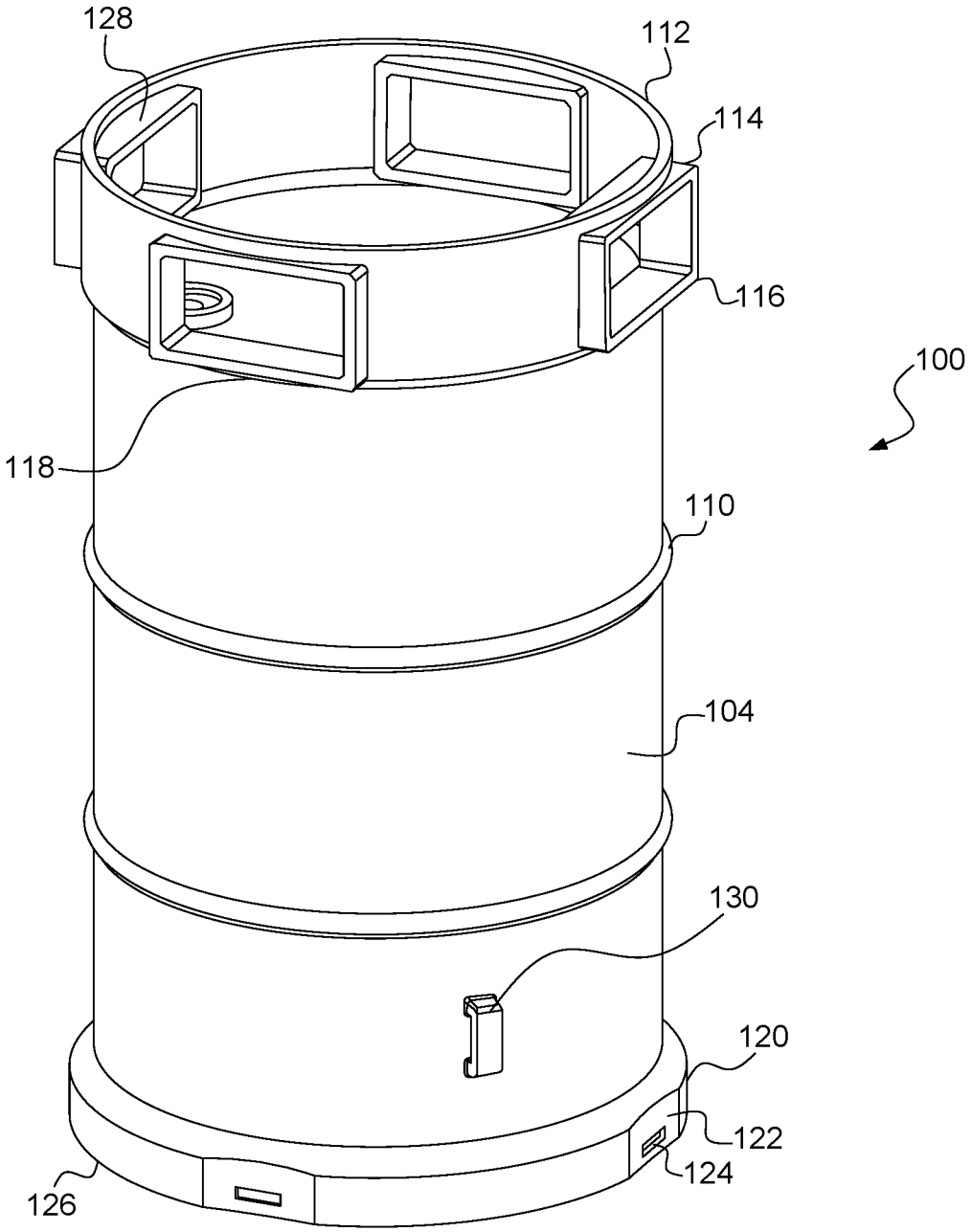
FIG. 1A depicts a forkliftable drum according to one embodiment.
Figure 1B:
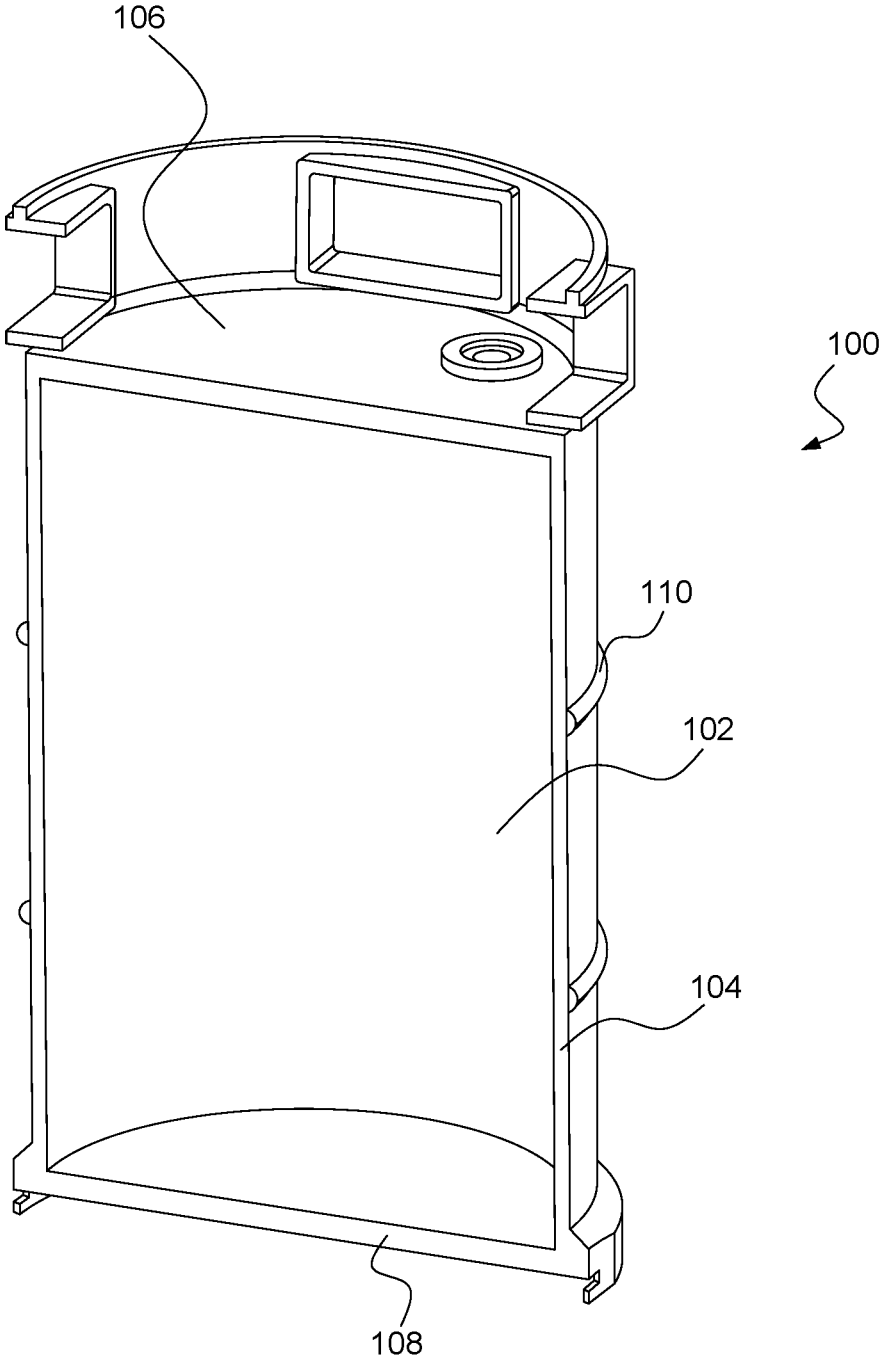
FIG. 1B depicts a cutaway view of the forkliftable drum of FIG. 1A.

FIGS. 1A and 1B show an embodiment of forkliftable drum 100. FIG. 1A shows an oblique view of drum 100 while FIG. 1B shows a cutaway view of the drum of FIG. 1A. Forkliftable drum 100 is comprised of a hollow cylindrical container having an interior volume 102 therein for holding materials such as liquids, pastes, powders, or any other material for storage or transport. Interior volume 102 is defined by a cylindrically-shaped body 104, as well as a thin disk-shaped top 106 and bottom 108. One or more rolling hoops 110 may be formed in body 104 to improve the strength and rigidity of the drum.

Connected to the top of drum 100 is a top ring 112. Top ring 112 is in the form of a thin-walled cylindrically-shaped section having an inner diameter, an outer diameter, and a height. The central axis of top ring 112 is collinear with the central axis of body 104. Top ring 112 has a plurality of rectangular forklift pockets 114 which pass through the top ring 112. The forklift pockets 114 have a rectangular tube shape with a hollow interior configured to accept a forklift fork. Each forklift pocket 114 has an outer edge 116 which is a planar surface parallel to the central axis of the drum that extends past the outer circumference of the top ring 112. The forklift pockets 114 are positioned around the top ring 112 at 90 degrees to one another, with opposing pockets aligned colinearly to create a passage through which a fork may pass. This arrangement allows a forklift operator to lift drum 100 from any of four sides by passing a forklift fork through any set of opposing pockets.

Forklift pockets 114 have a number of functions. Forklift pockets 114 help guide a fork of a forklift through the top ring, reducing the likelihood of damage to the top ring 112, the drum top 106 or any fitting in the drum top. Forklift pockets 114 also reinforce the lifting point of the drum, improving the strength. When two or more drums are horizontally bundled, the outer edges 116 of the forklift pockets 114 of each drum rest against each other, providing stability for the bundle.

Below each forklift pocket 114 is an upper strapping hole 118 which passes through top ring 112. Each upper strapping hole 118 is rectangular or oval in shape and is sized to accept a strap for securing two or more drums into a bundle.

Connected to the bottom of forkliftable drum 100 is a bottom ring 120 in the form of a thin-walled cylindrically-shaped section which extends downward past bottom 108. The central axis of bottom ring 120 is collinear with the central axis of body 104. Bottom ring 120 has a plurality of flats 122 which are aligned vertically with the forklift pockets 114. Flats 122 are planar sections which may be formed in bottom ring 120, such as by a press or may be attached to bottom ring 120, such as by being welded into an opening in bottom ring 120. Flats 122 are parallel with outer edge 116. Each of flats 122 has a lower strapping hole 124 formed therein which passes through the flat. Lower strapping holes 124 are rectangular or oval in shape and are sized to accept a strap for securing two or more drums into a bundle. When bundled, the flat of one drum may rest against the flat of another drum, providing stability for the bundle.

Bottom ring 120 is sized to fit within top ring 112 to allow drums to be securely stacked. That is, the outer diameter of bottom ring 120 is smaller than the inner diameter of top ring 112 such that any two drums are nestable. The bottom edge 126 of bottom ring 120 and flats 122 are designed to rest on the upper edge 128 of the forklift pockets 114 of another drum. Therefore, no part of the upper drum extends into the passage between the forklift pockets 114 of the lower drum and the bundle may be lifted and transported using the forklift pockets of the lower drum.

Attached to body 104 are one or more strapping holders 130. Strapping holders 130 are designed to hold strapping in place when drums are bundled together. Strapping holders 130 may be comprised of a substantially flat section of metal welded onto the outside of body 104. Alternatively, a "C"-shaped section may be attached to body 104 to create strapping holders 130. Strapping holders 130 may be designed to take load or may simply be designed to keep a strap from moving during transport.

Top ring 112 may be formed integrally with body 104 or top 106. Top ring 112 may also be attached to one or both of body 104 and top 106. Top ring 112 may be attached by welding, crimping, threaded fasteners, adhesives, or any combination thereof. Bottom ring 120 may be formed integrally with body 104 or bottom 108. Bottom ring may also be attached to one or both of body 104 and bottom 108. Bottom ring 120 may be attached by welding, crimping, threaded fastener, adhesives, or any combination thereof.

While drum 100 is shown as being cylindrically shaped, the invention is not limited thereto and drum 100 may be rectangular, square, oblong, etc.

Drum 100 can be made of any suitable material but preferably metals or polymers. For example, drum 100 may be made of steel, stainless steel, or aluminum. Suitable polymers include nylon, polypropylene, polyethylene, ABS, and polycarbonate. Drum 100 may also be manufactured from a combination of materials. For example, the forklift pockets may be made of steel and the rest of the drum made of polymer.

Unlike conventional drums, forkliftable drums disclosed herein may be made in a variety of capacities all having the same diameter but with different heights. Because of this, bundles can be formed of varying drum capacities for better space utilization in trucks, shipping containers, etc.

Figure 2A:
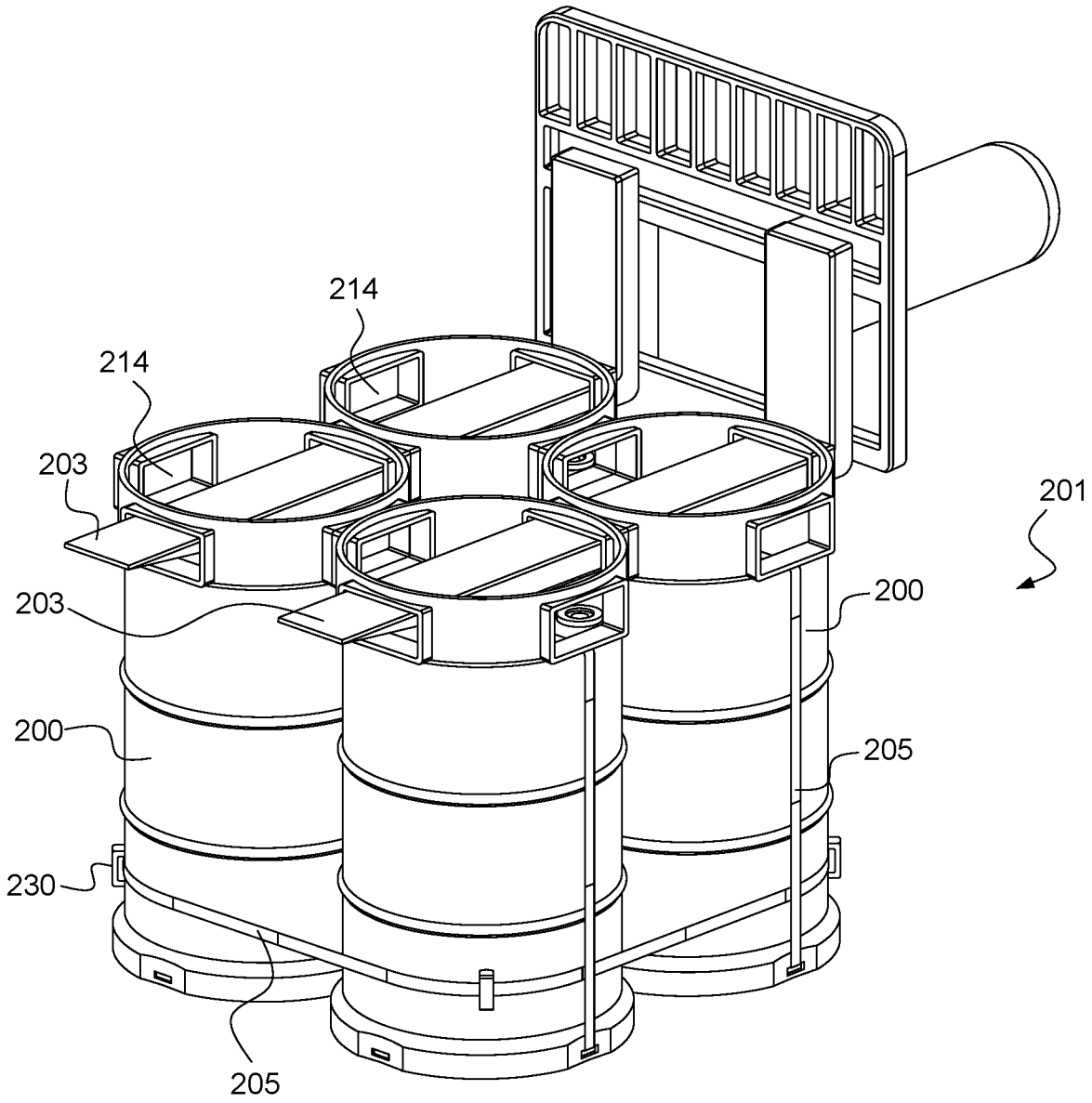
FIG. 2A depicts a bundle of four forkliftable drums arranged horizontally on a set of forklift forks.

For example, FIG. 2A shows four drums 200 connected horizontally to form a bundle 201. Forklift forks 203 are shown engaged with bundle 201 as would be typical when lifting or moving the bundle. As can be seen, each of the forklift forks 203 passes through two forklift pockets 214 of each drum 200. When bundle 201 is created, each drum 200 is aligned in the manner shown in FIG. 2A with the forklift pockets of adjacent drums being approximately collinear.

Strapping 205 is used to secure the individual drums 200 to form the bundle 201. The strapping may be horizontal, held in place by strapping holders 230 or the strapping may be vertical by passing strapping through upper or lower strapping holes.

Figure 2B:
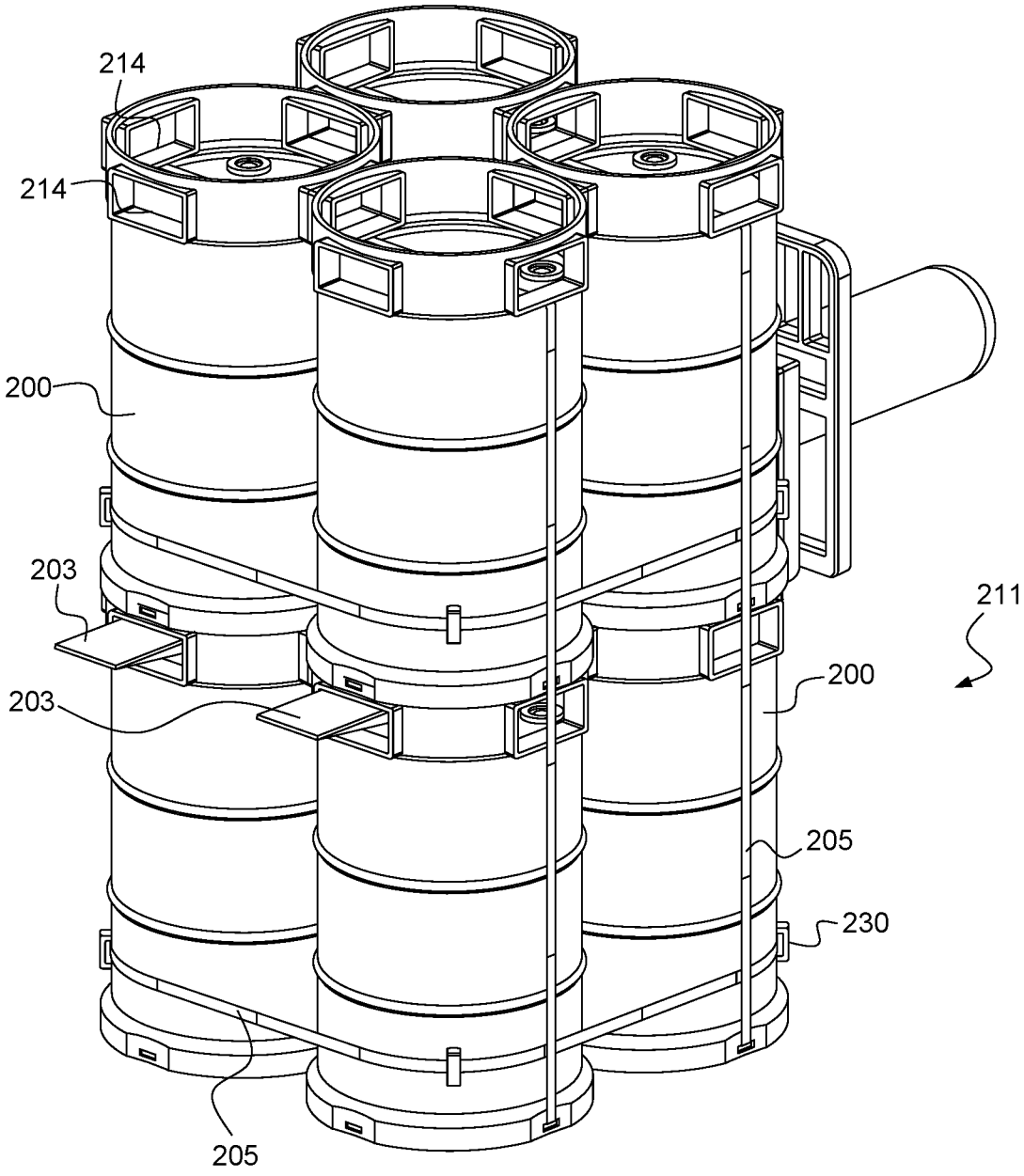
FIG. 2B depicts a bundle of eight forkliftable drums arranged on a set of forklift forks.

FIG. 2B shows eight drums connected to form a bundle 211. The bundle 211 shown in FIG. 2B is essentially comprised of two bundles 201 from FIG. 2A stacked vertically. In bundle 211, vertical straps 205 extend from the bottom drums to the top drums.

When forming a bundle, the drums 200 may be manually aligned or a forklift may be used. For example, a forklift is driven to a first location and picks up a first drum on one fork. The forklift may then drive to a second location and pick up a second drum on the same fork or another fork. This process is repeated until the forklift has two drums on each fork. The forklift driver drives the drums to a bundling location and sets the drums down. The forks may be pushed together by the forklift driver to bring the drums on the left and right forks together, and the driver may set the drums down and push them with the forklift to bring the front and rear drums together. The driver may then back the forklift out from the set of drums, which are now aligned while workers bundle the drums together.

By placing the forklift holes on the top of the drum, the drum may be carried such that the center of gravity is below the fork, creating a stable configuration. When drums are carried on pallets, the center of gravity remains above the forks, allowing for the possibility of the pallet to tip or the drum to fall.

Although the drums described herein may be lifted with a forklift, they are not limited solely to forklifts. For example, straps may be passed through the forklift pockets to allow lifting by overhead crane, helicopter, or large drone.

Figure 3A:
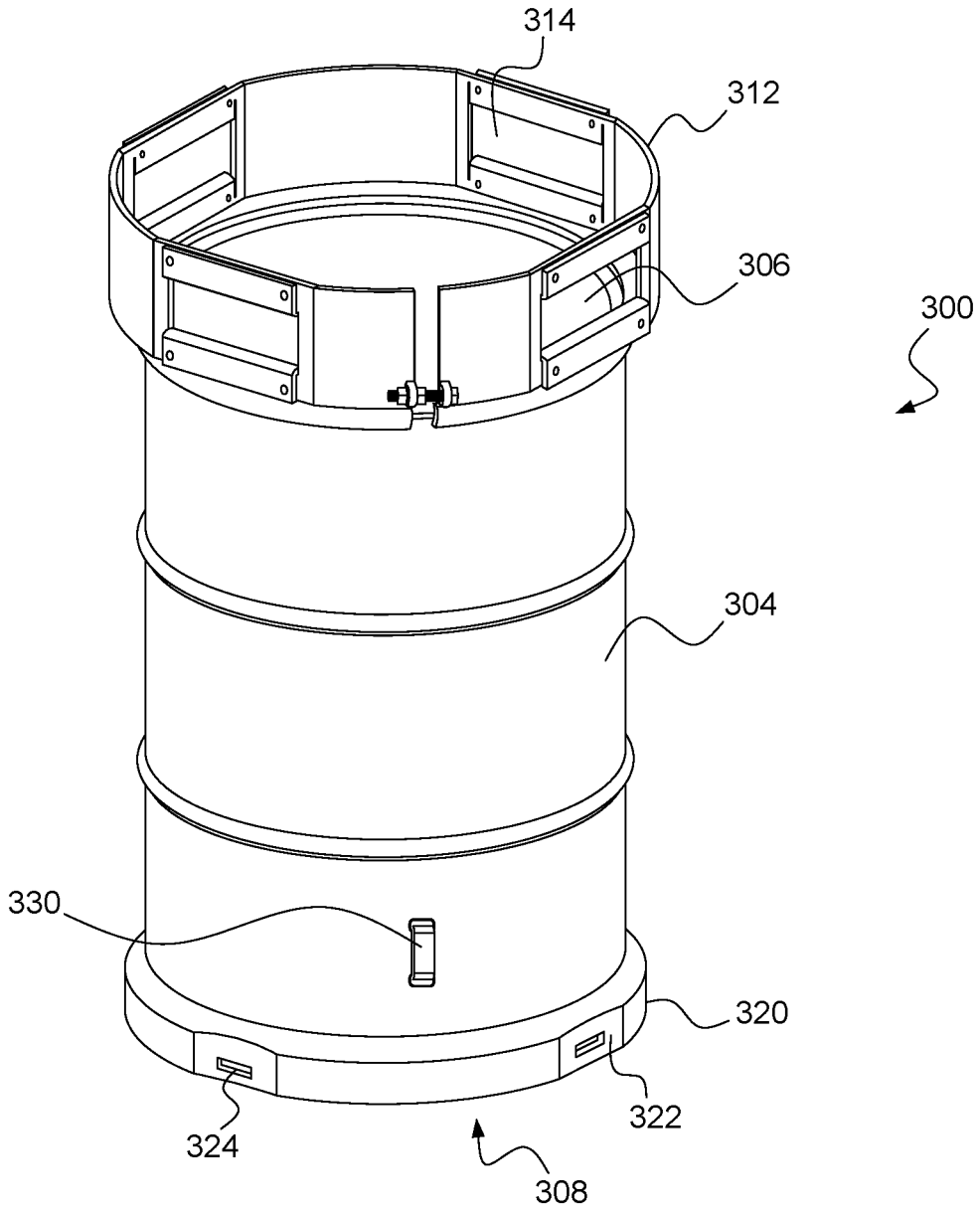
FIG. 3A depicts a forkliftable drum with removable top ring according to one embodiment.
Figure 3B:
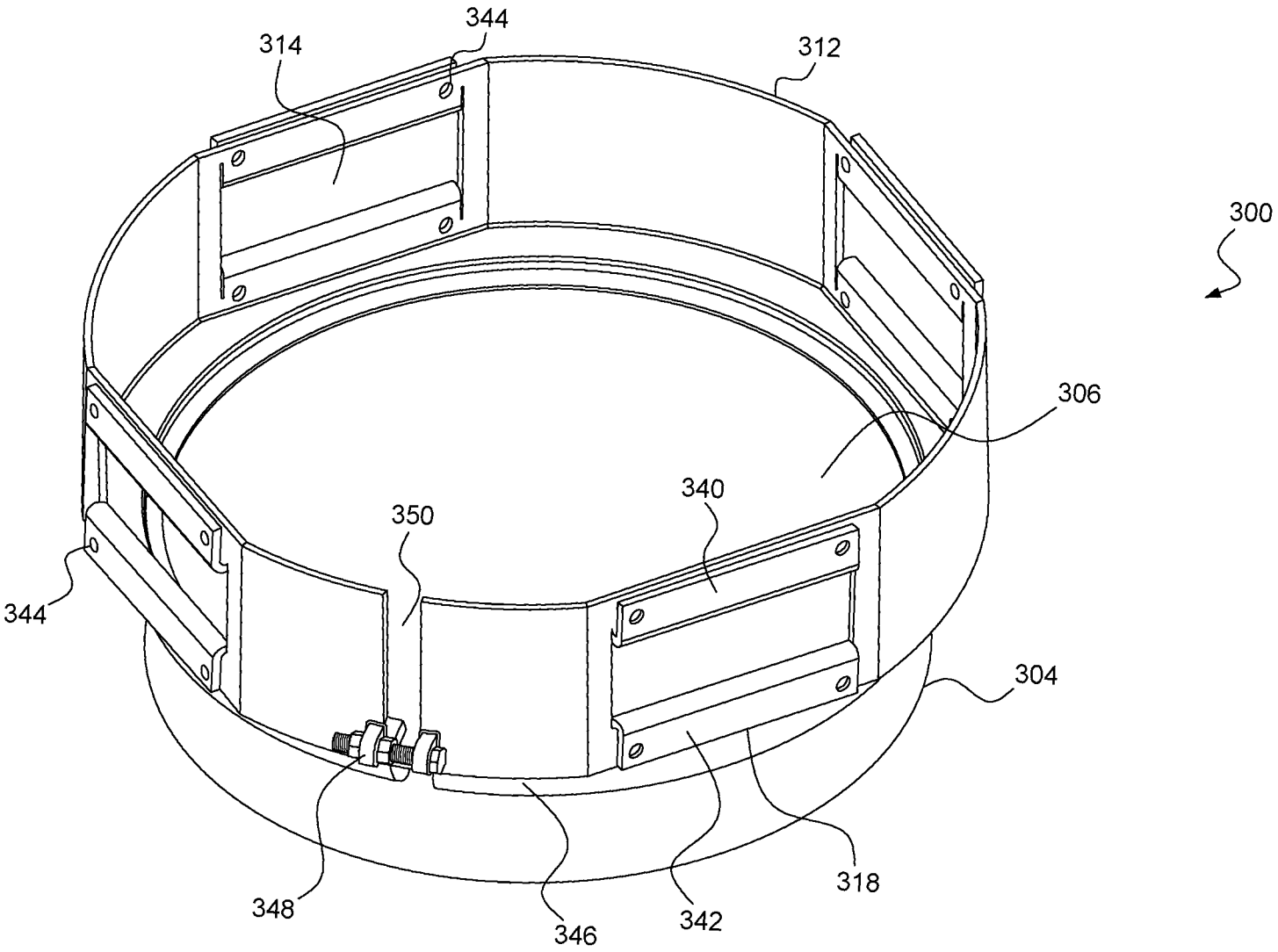
FIG. 3B depicts the top section of the forkliftable drum of FIG. 3A.
Figure 3C:
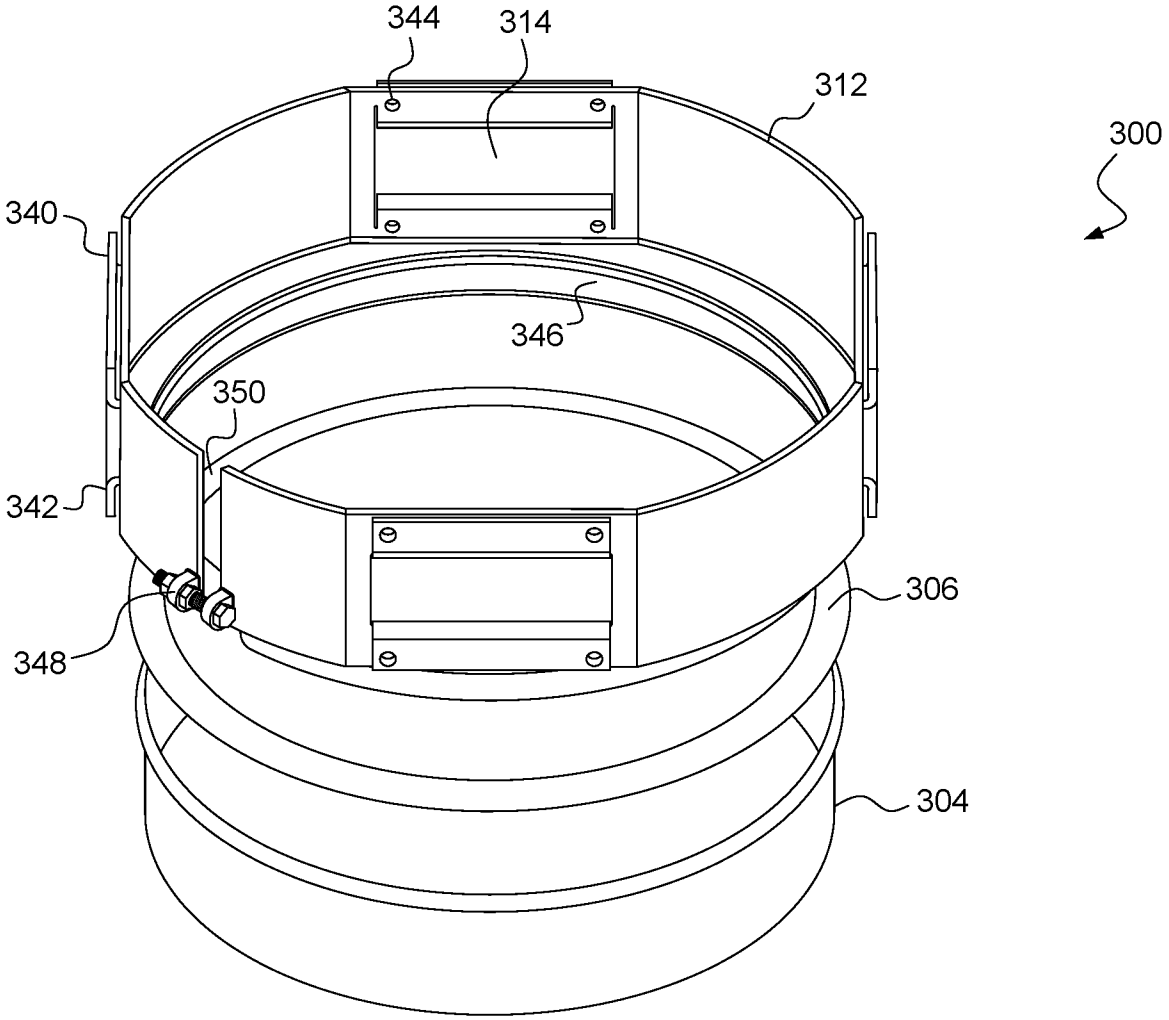
FIG. 3C depicts an exploded view of the top section in FIG. 3B.

FIGS. 3A-C show a forkliftable drum 300 according to another embodiment. FIG. 3A shows the entire drum 300. FIG. 3C is an exploded view of the upper drum components shown in FIG. 3B.

Forkliftable drum 300 is comprised of a hollow cylindrical container having an interior volume therein for holding materials. The interior volume is defined by a cylindrically-shaped body 304, as well as a thin disk-shaped top 306 and bottom 308. Top 306 is removable from body 304 to provide access to the interior volume of the drum.

Connected to the top of drum 300 is a top ring 312. Top ring 312 is in the form of a thin-walled cylindrically-shaped ring having an inner surface, an outer surface, and a height. The central axis of top ring 312 is collinear with the central axis of body 304. Top ring 312 has a plurality of rectangular forklift pockets 314 which define openings which pass through the top ring 312. The forklift pockets 314 have a rectangular shape configured to accept a forklift fork. The forklift pockets 314 are positioned around the top ring 312 at 90 degrees to one another, with opposing pockets aligned colinearly to create a passage through which a fork may pass. This arrangement allows a forklift operator to lift drum 300 from any of four sides by passing a forklift fork through any set of opposing pockets.

Forklift pockets 314 have an upper flange 340 and a lower flange 342 formed by bending a section of the top ring 180 degrees. The section of top ring 312 near each forklift pocket 314 has a planar shape with the remaining sections of top ring 312 having curves or angles in between to create an overall roughly cylindrical shape. Holes 344 pass through upper flange 340 and lower flange 342 as well as the main body of top ring 312 to provide a means to attach two drums together. A fastener such as a bolt, screw, or rivet can be passed through the corresponding holes in two adjacent drums. Upper and lower flanges 340 and 342 may have dimples, a rough surface, or other features that create friction or a positive lock when two drums are attached to decrease the likelihood of the drums shifting.

Below each forklift pocket 314 is an upper strapping hole 318 which passes through top ring 312. Each upper strapping hole 318 is rectangular or oval in shape and is sized to accept a strap for securing two or more drums into a bundle.

Top ring 312 is attached to body 304 by clamping around the upper edge of body 304 in the same manner as a standard closing ring. That is, the upper edge of body 304 and the outer edge of top 306 are rounded so as to create a partial toroidal shape which is encompassed by a partially toroidally-shaped locking section 346 of top ring 312. The clamping is provided by nut and bolt clamp 348 but other mechanisms may be used, such as a lever lock mechanism. A gap 350 in top ring 312 allows top ring 312 to expand and contract to allow installation and removal of top ring 312 as well as top 306. Top ring 312 can therefore be used on existing drums to convert standard drums into a forkliftable drum. Additionally, top ring 312 can be used on both open top and closed top drums.

The unique design of top ring 312 allows it to be manufactured primarily from a single section of sheet metal. Upper flange 340 and lower flange 342 may be formed my creating an H or I shaped cut and bending the flanges 180 degrees. The flat section may be formed to create locking section 346 as well as the overall cylindrical shape of top ring 312.

Connected to the bottom of forkliftable drum 300 is a bottom ring 320 in the form of a thin-walled cylindrically-shaped section which extends downward past bottom 308. The central axis of bottom ring 320 is collinear with the central axis of body 304. Bottom ring 320 has a plurality of flats 322 which are aligned vertically with the forklift pockets 314. Flats 322 are planar sections which may be formed in bottom ring 320, such as by a press or may be attached to bottom ring 320, such as by being welded into an opening in bottom ring 320. Flats 322 are parallel with the planar area around pockets 314. Each of flats 322 has a lower strapping hole 324 formed therein which passes through the flat. Lower strapping holes 324 are rectangular or oval in shape and are sized to accept a strap for securing two or more drums into a bundle. When bundled, the flat of one drum may rest against the flat of another drum, providing stability for the bundle.

Bottom ring 320 is sized to fit within top ring 312 to allow drums to be securely stacked. That is, the outer diameter of bottom ring 320 is smaller than the inner diameter of top ring 312 such that any two drums are nestable. Bottom ring 320 and top ring 312 are designed so that bottom ring 322 does not block forklift pockets 314. For example, a flange or lip may be created on bottom ring 320 or top ring 312. Alternatively, a protrusion may be pressed, punched, or welded onto the inside of top ring 312 or the outside of bottom ring 320. Upper flange 340 may also be bent inward, such as at a 90 degree angle parallel to top 306.

Attached to body 304 are one or more strapping holders 330. Strapping holders 330 are designed to hold strapping in place when drums are bundled together. Strapping holders 330 may be comprised of a substantially flat section of metal welded onto the outside of body 304. Alternatively, a "C"-shaped section may be attached to body 304 to create strapping holders 330. Strapping holders 330 may be designed to take load or may simply be designed to keep a strap from moving during transport.

The discussion herein of the present invention is directed to various embodiments of the invention. The term "invention" is not intended to refer to any particular embodiment or otherwise limit the scope of the disclosure. Although one or more of these embodiments may be preferred, the embodiments disclosed should not be interpreted, or otherwise used, as limiting the scope of the disclosure, including the claims. In addition, one skilled in the art will understand that the description has broad application, and the discussion of any embodiment is meant only to be exemplary of that embodiment, and not intended to limit that the scope of the disclosure, including the claims, is limited to that embodiment.

Herein, the terms "including," "consisting of", and "comprising" are used in an open-ended fashion, and thus should be interpreted to mean "including, but not limited to." Also, the term "connect" or "connected" where used if at all is intended to mean either an indirect or direct connection. Thus, if a first component connects to a second component, that connection may be through a direct connection or through an indirect connection via other components and connections.

Certain terms are used throughout the description and claims to refer to particular system components and method steps. As one skilled in the art will appreciate, different companies may refer to a component by different names. This document does not intend to distinguish between components that differ in name but not function.

It is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A forkliftable drum comprising:

a cylindrical body having a top and a bottom defining an interior volume therein, a top ring attached to an upper edge of the cylindrical body, the top ring extending above the top; and at least two forklift pockets in the top ring, the forklift pockets configured to accept a fork of a forklift, wherein each forklift pocket comprises a rectangular tube which passes through the top ring from an outside diameter of the top ring to and inside diameter of the top ring.

2. The forkliftable drum of claim 1, wherein the forklift pockets further comprise:

an upper flange; and a lower flange.

3. The forkliftable drum of claim 2, wherein the top ring comprises one or more holes which pass through the top ring and the upper flange or the lower flange.

4. The forkliftable drum of claim 1, wherein the forklift pockets have a planar outer edge that extends beyond an outer circumference of the top ring.

5. The forkliftable drum of claim 1, further comprising:

an upper strapping hole in the top ring.

6. The forkliftable drum of claim 1, further comprising:

a bottom ring attached to a lower end of the cylindrical body having:

a plurality of flats vertically aligned with the forklift pockets in the top ring.

7. The forkliftable drum of claim 6, further comprising:

a strapping hole in one or more of the plurality of flats of the bottom ring.

8. The forkliftable drum of claim 6, wherein the bottom ring is sized to fit within the top ring.

9. The forkliftable drum of claim 1, further comprising:

a strapping holder attached to the cylindrical body.

10. A forkliftable drum comprising:

a cylindrical body having a top and a bottom defining an interior volume therein, a top ring removably attached to an upper edge of the cylindrical body, the top ring extending above the top; and at least two forklift pockets in the top ring, the forklift pockets configured to accept a fork of a forklift, a locking section configured to secure the top ring on the body, and a clamping means for attaching and releasing the top ring from the cylindrical body, wherein each forklift pocket comprises a rectangular tube which passes through the top ring from an outside diameter of the top ring to and inside diameter of the top ring.

11. The forkliftable drum of claim 10, wherein the top ring forklift pockets further comprise:

an upper flange; and a lower flange.

12. The forkliftable drum of claim 11, wherein the top ring comprises one or more holes which pass through the top ring and the upper flange or the lower flange.

13. The forkliftable drum of claim 10, wherein the forklift pockets have a planar outer edge that extends beyond an outer circumference of the top ring.

14. The forkliftable drum of claim 10, further comprising:

an upper strapping hole in the top ring.

15. The forkliftable drum of claim 10, further comprising:

a bottom ring attached to a lower end of the cylindrical body having:

a plurality of flats vertically aligned with the forklift pockets in the top ring.

16. The forkliftable drum of claim 15, further comprising:

a strapping hole in one or more of the plurality of flats of the bottom ring.

17. The forkliftable drum of claim 15, wherein the bottom ring is sized to fit within the top ring.

18. The forkliftable drum of claim 10, further comprising:

a strapping holder attached to the cylindrical body.

* * * * *